US006564950B1

(12) United States Patent
Holm

(10) Patent No.: US 6,564,950 B1
(45) Date of Patent: May 20, 2003

(54) DETACHABLE OR ATTACHABLE HOLDER

(75) Inventor: Leif Holm, Munkfors (SE)

(73) Assignee: Harry Holms AB, Munkfors (SE)

( * ) Notice: Subject to any disclaimer, the term of this patent is extended or adjusted under 35 U.S.C. 154(b) by 0 days.

(21) Appl. No.: 09/926,617

(22) PCT Filed: May 30, 2000

(86) PCT No.: PCT/SE00/01115

§ 371 (c)(1),
(2), (4) Date: Dec. 17, 2001

(87) PCT Pub. No.: WO00/74530

PCT Pub. Date: Dec. 14, 2000

(30) Foreign Application Priority Data

Jun. 3, 1999 (SE) ..... 9902042

(51) Int. Cl.[7] ..... A47F 5/00

(52) U.S. Cl. ..... 211/85.31; 211/106; 211/181.1; 248/905; 248/316.7

(58) Field of Search ..... 211/119, 85.31, 211/89.01, 106, 181.1, 85.17; 248/905, 316.7

(56) References Cited

U.S. PATENT DOCUMENTS 2,491,515 A * 12/1949 Orchard
2,784,931 A * 3/1957 Martin
3,089,597 A * 5/1963 Kaplan
3,096,883 A * 7/1963 Llewellyn
3,489,385 A * 1/1970 Dill
4,094,416 A * 6/1978 Smith ..... 211/71.01
D295,127 S * 4/1988 Chap
4,813,535 A * 3/1989 Radocha et al. ..... 211/106 X
D318,349 S * 7/1991 Nass
5,099,993 A * 3/1992 Lewington et al.
5,143,230 A * 9/1992 LaCorte ..... 211/71.01
5,197,705 A * 3/1993 Baskas ..... 248/316.7
5,884,784 A * 3/1999 Betts ..... 211/88.01

* cited by examiner

*Primary Examiner*—Robert W. Gibson, Jr,
(74) *Attorney, Agent, or Firm*—Dennison, Schultz & Dougherty

(57) ABSTRACT

A detachable holder is provided having a frame with a pair of outer longitudinally extending wire portions, a pair of inner longitudinal wire portions extending substantially the length of the frame and substantially parallel to the pair of outer longitudinally extending wire portions. The detachable holder also includes a plurality of support units securably attached to the frame, and a plurality of movable wire loops each having a first end and a second end, wherein the first end is movably secured between the pair of outer longitudinally extending wire portions and the pair of inner longitudinal wire portions.

5 Claims, 5 Drawing Sheets

DETACHABLE OR ATTACHABLE HOLDER

Figure 1:
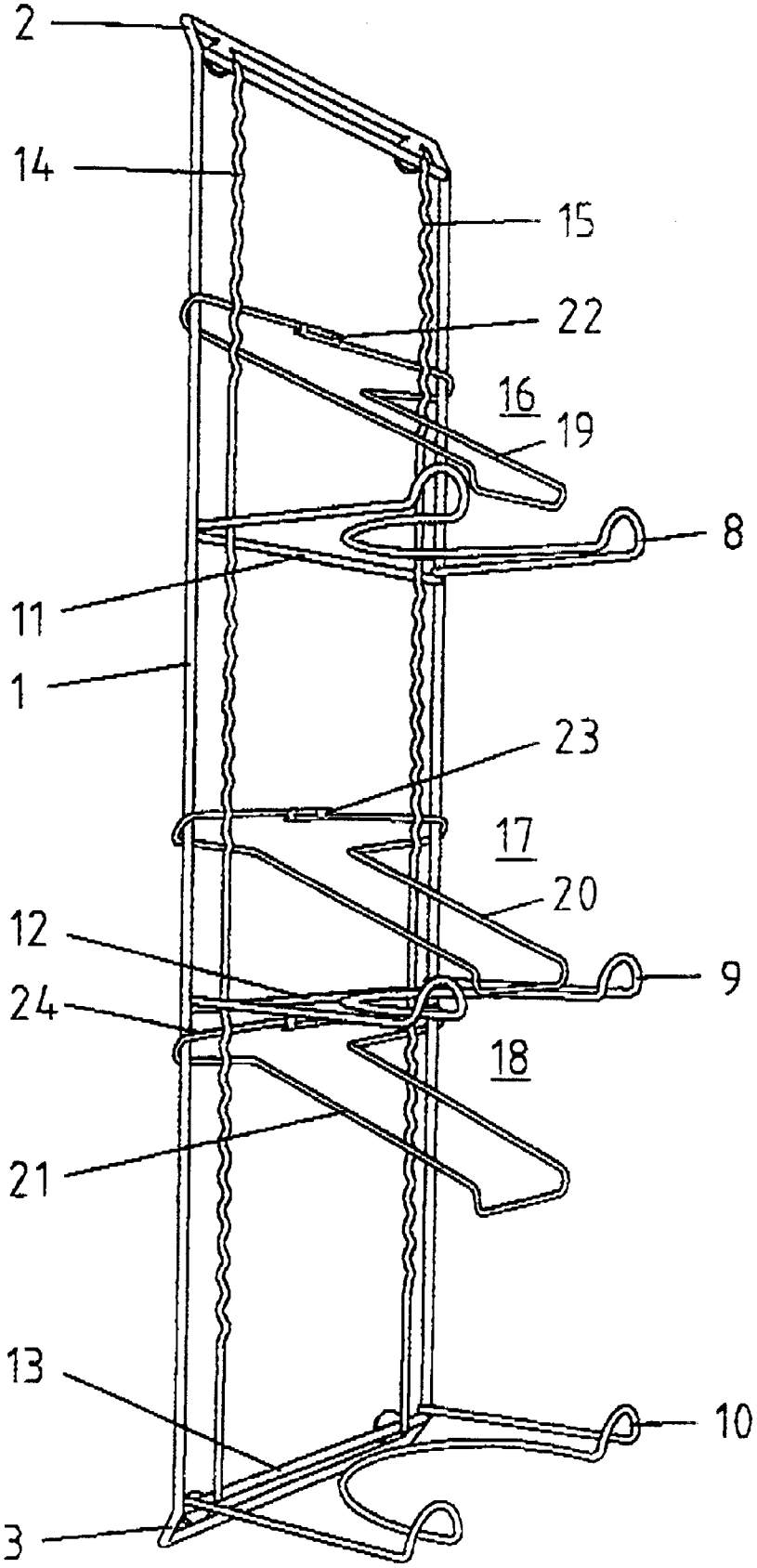

The present invention relates to a detachable or attachable holder having a first unit on which an object can be placed and a second unit to retain the object to the first-mentioned unit. Such holders may be made from various materials. There is a need for such holders at hospitals and various storage premises and the like, where disposable articles must be taken out of boxes. It is extremely advantageous if these boxes are arranged in one place and are stationary even when one disposable unit is removed.

In accordance with the invention the holder itself comprises a frame and to this is attached a first unit designed to act as a shelf. Several shelves may be arranged one above the other in the frame and the shelves may also be moved to different positions along the frame. The condition is that when the shelf is in operation it shall be immovable in relation to the frame. The second unit may be designed to keep an object pressed against a shelf and the second unit may be designed to be movable along the frame to achieve the desired function. It also assumes an inclined, downwardly directed resting position in relation to the unit of the first type located below it, which constitutes a shelf. The second unit has a resting position and can be manually removed from this but always strives to return to its original position after manual actuation. The frame is intended for attachment to a wall surface, but may naturally be provided with legs or some other arrangement so that the frame is placed as a stand in a suitable work place.

It has now proved particularly suitable, and also simple, to manufacture a holder of the type described above from only wire. However, the holder may naturally be made from sheet metal or the like. Wires of various material may be used for the purpose. However, metal wire is preferred. The wires used in the construction may have different dimensions. The parts to form the shelves may thus consist of wire bent to a U-shape, with a yoke part and two legs and the free ends of the two legs can be welded to a frame. Alternatively the frame may be provided with holes or some other arrangement into which the parts are inserted, or the frame may be provided with a number of sleeves into which the ends of the U-shaped wire to constitute the shelf are inserted. A rigid construction is thus obtained between shelf and frame. The frame generally consists of a piece of wire bent to form a rectangle. The ends of the rectangle are bent in the same direction so that the longitudinal portions of the wire that form the rectangular unit will be spaced from a surface if the frame is attached to a surface. Both ends of the frame are provided with plates having holes, to enable attachment of the frame to a surface. The frame may also be provided with legs at the longitudinal parts of the rectangular frame, which can be placed against a support surface such as the surface of a bench, so that one end piece of the frame and the legs cause the holder to assume a position as a stand.

The rectangular wire frame has two parallel wires between its sides and secured to the end pieces of the frame. These wires have a rough surface or lie in a plane that is perpendicular to the frame itself, but not entirely straight, having either wavy or saw-toothed form As mentioned earlier, the frame has a number of holes or sleeves attached to it for receiving the ends of the U-shaped part that is to constitute a shelf, so that the relationship between frame and shelf is rigid. The free ends of the U-shaped part may of course be welded to the rectangular frame. It is also suitable to arrange a transverse stay between the welding points.

The second unit, that shall constitute a clamping arrangement for the object placed on a shelf, is in the nature of an endless loop having an oval part running between the longitudinal wires of the holder, and a protruding part that is somehow located above a shelf. The two longitudinal wires pass through said oval at its ends. The oval has two substantially parallel parts and these are situated beneath the two interjacent wires that shall have a rough surface. This enables a clamping unit to be displaced upwardly or downwardly thanks to the rough surface of the interjacent wires. The protruding part of the endless wire unit will be directed downwards but, since the wire does not have a large diameter, it will act as a spring that is in spring abutment with an object below it.

The unit forming a shelf is also provided with an upwardly bent part at its outer edge, just as the spring arrangement has a downwardly bent part. This means that any object placed between the two units is unable to move outwardly since the downwardly and upwardly bent parts prevent any outward movement.

A number of boxes with openings for disposable products, for instance, can be clamped in a holder of the type under discussion. When the holder is then anchored in one way or another, there is no difficulty in removing one article at a time without the position of the boxes being displaced.

Further characteristics of the present invention are disclosed in the appended claims.

Figure 2:
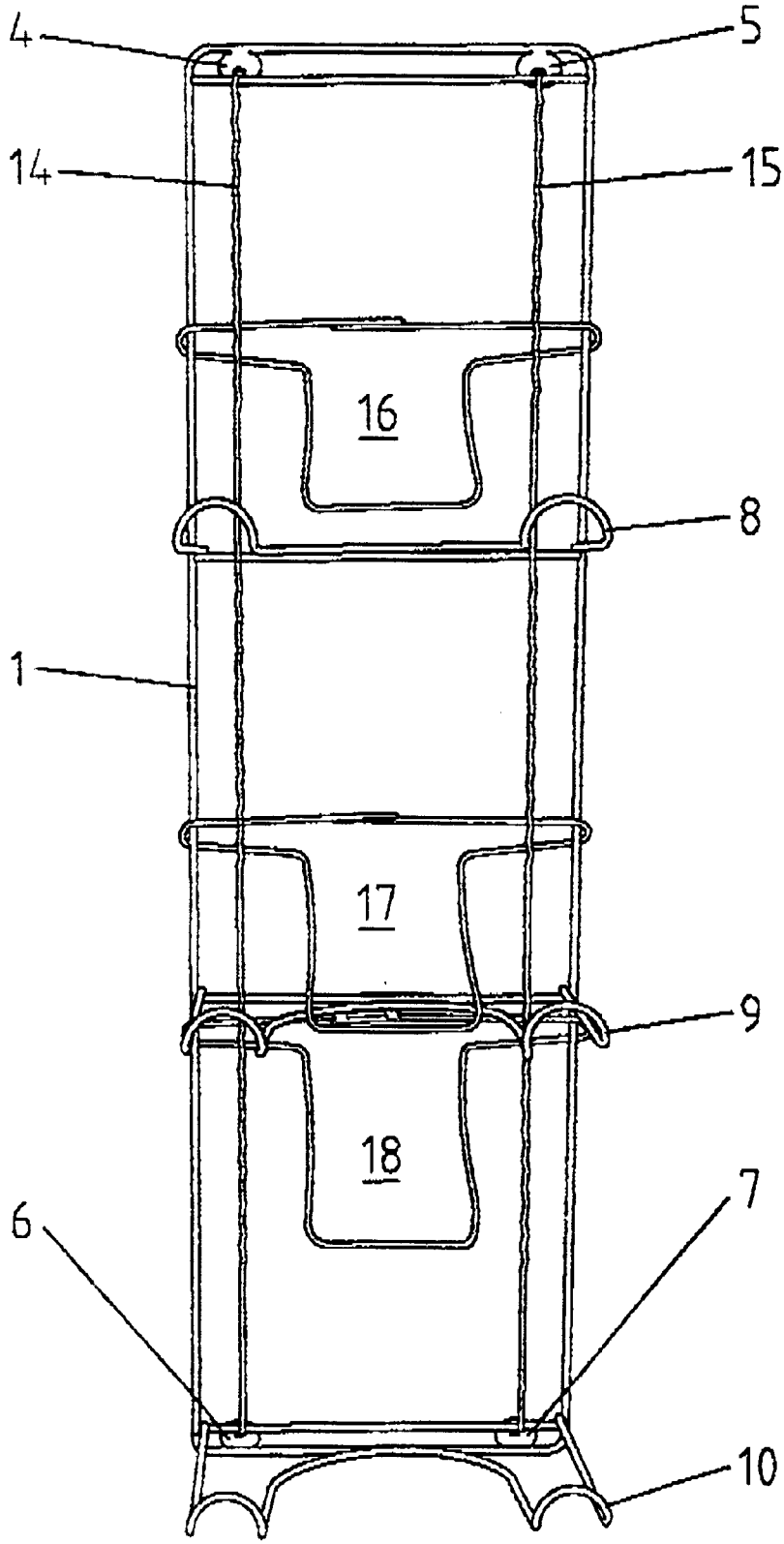
Figure 3:
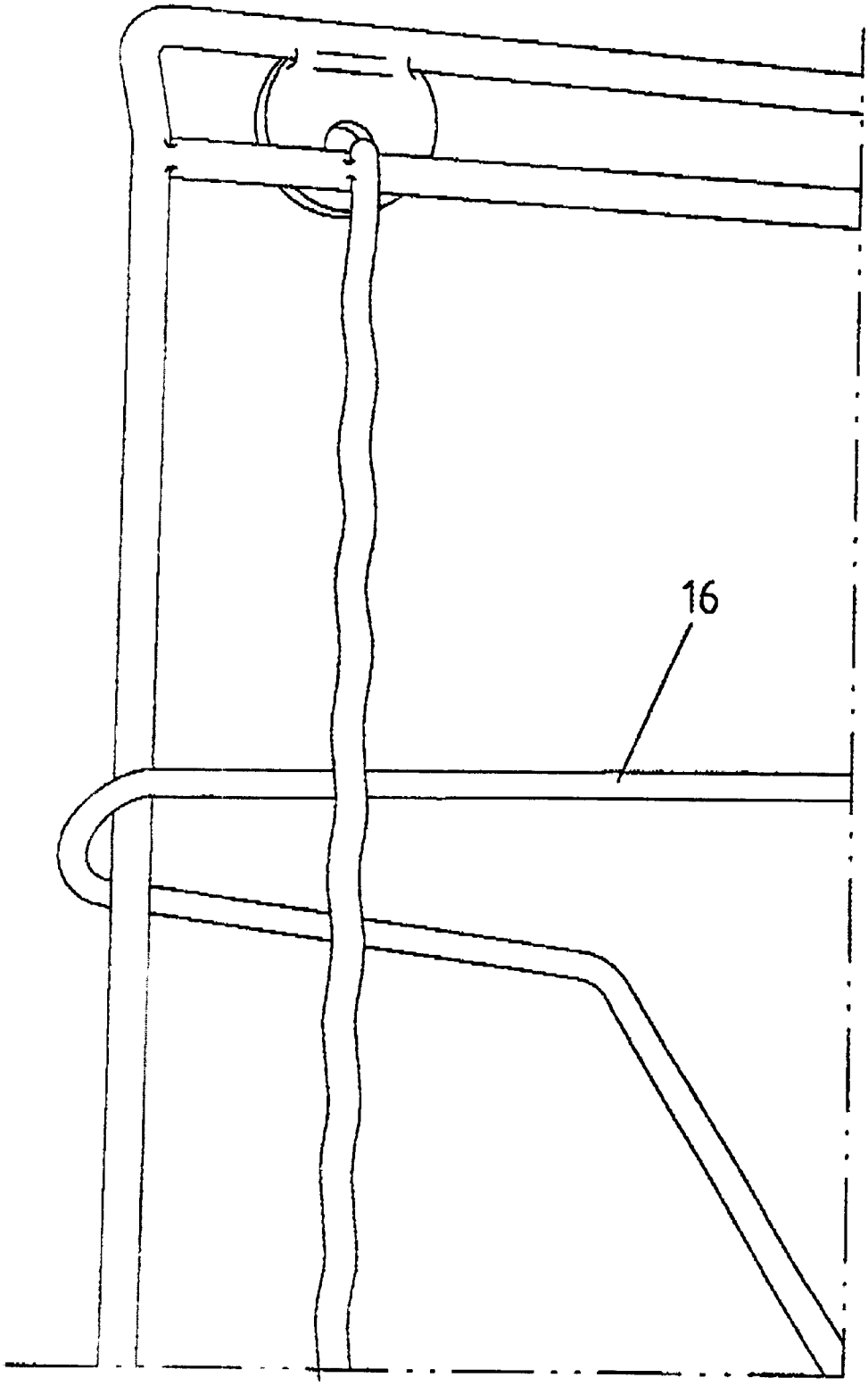
Figure 4:
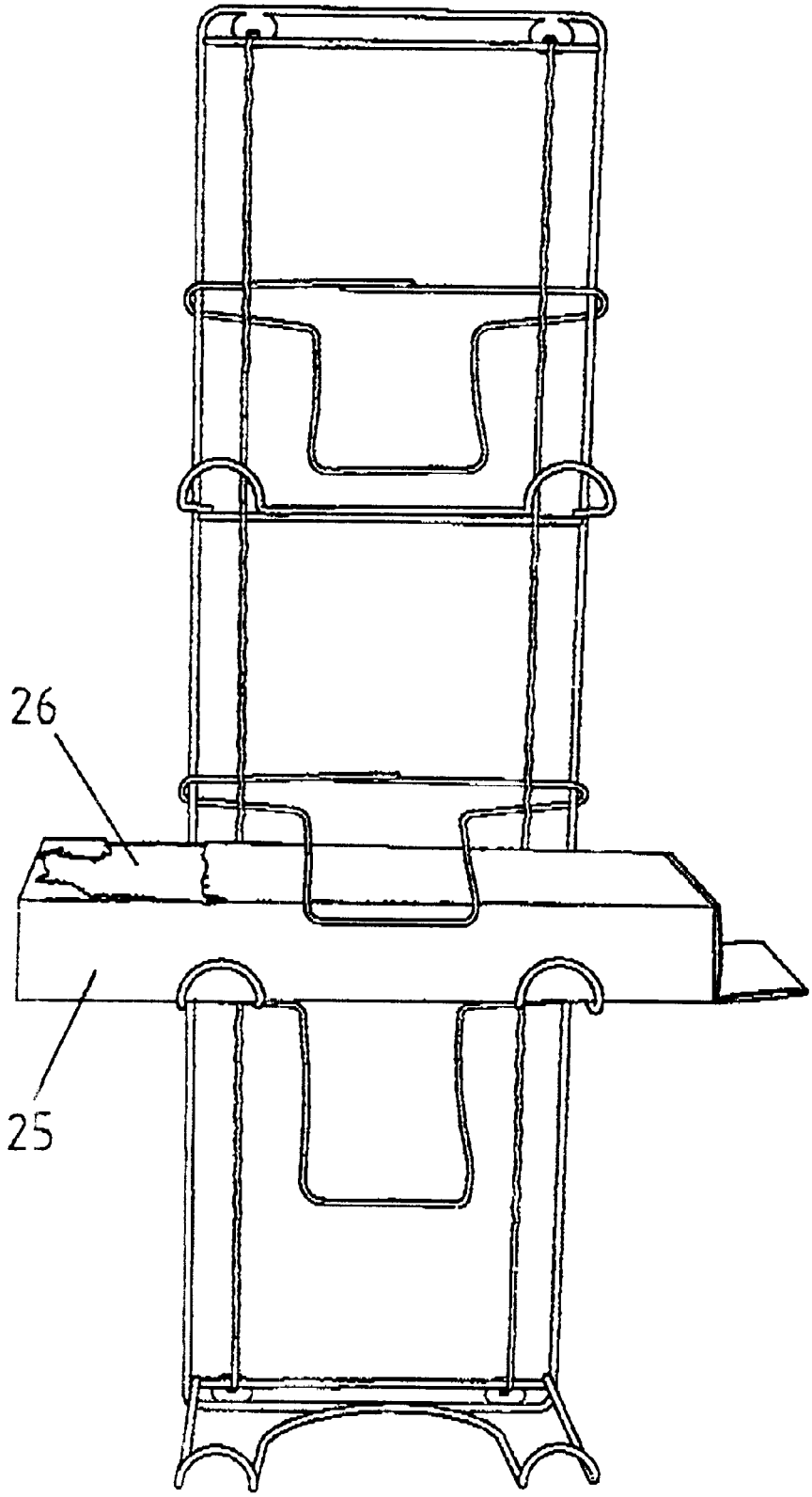
Figure 5:
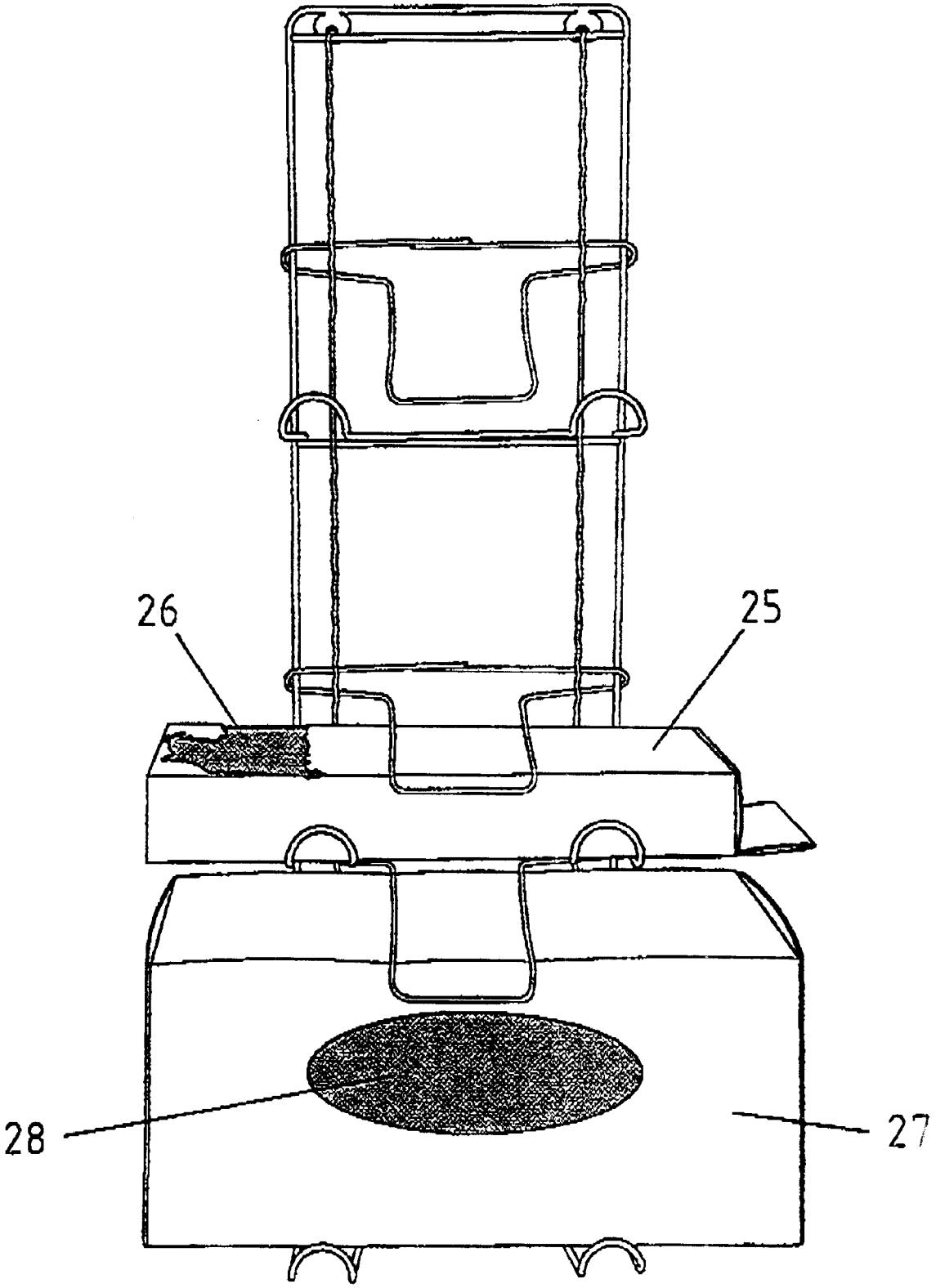

The present invention will be further described with reference to five sheets of drawings, in which FIG. 1 shows a holder with its shelves and its clamping arrangements made entirely out of wire material, FIG. 2 shows the same holder as in FIG. 1, seen from the front, FIG. 3 shows an enlarged view of how the spring unit is locked in different positions, FIG. 4 shows a holder in accordance with FIG. 3, carrying a box, and FIG. 5 shows the same holder as in FIG. 4, carrying two boxes.

FIGS. 1 and 2 show a holder of wire material forming a frame. This has been designated 1, is rectangular and has two end pieces 2 and 3. The end pieces 2 and 3 are bent slightly inwards so that when the holder is placed against a flat surface the longitudinal wire portions thereof will be situated a short distance above the surface. The end pieces of the holder are provided with four attachment plates 4, 5, 6 and 7, intended for attaching the holder to a wall. The attachment plates are provided with holes. The frame has three units 8, 9 and 10 consisting of wire bent to form a U, the free ends of which are welded to the longitudinal wire portions of the frame 1. Each shelf produced has two upwardly directed parts so that if an object is placed on a shelf it cannot be displaced further outwards than when it encounters the raised parts. Naturally the two ends of the unit 10 may be inserted into holes drilled into the longitudinal wire portions of the frame 1. Alternatively, sleeves may be secured to the frame 1 into which the ends of a unit 10 can be inserted so that a rigid relationship between frame 1 and shelf 10 is always obtained. Inside its outer, longitudinal wire portions the frame 1 is provided with two parallel, longitudinal wire portions 14 and 15, situated inside the wire parts of the frame 1. These wire portions 14 and 15 have a non-smooth surface. They may also be such that in a plane perpendicular to the frame 1 they have a saw-toothed extension or a wave-shaped extension. The second unit, comprising a clamping unit, can thus be displaced upwardly and downwardly and consists of an endless loop formed by a wire 16. The endless wire has an oval part designated 22 and an outwardly directed part designated 19. The oval part of the wire 16 is provided at its ends with two substantially parallel portions. These portions are situated below the wires 14 and 15, and the longitudinal wires of the frame 1 pass through the end parts of the wire oval 22. Thanks to the contact between the oval part and the longitudinal parts of the frame 1 and the wires 14 and 15, the clamping part 16 can be moved up and down in various positions. The part 19 is bent downwards at its front end.

A holder in accordance with FIG. 5 can be applied on a wall and a box 27 be subsequently placed on the shelf 10. Prior to this, the spring device 18 is moved up to a position such that, when the spring device is released, it will engage with the upper side of the box 27, thus retaining the box 27 firmly in the holder. A second box 25 may then be placed in the holder, in which case the clamping device 17 must be moved to the position where it provides full pressure on the box.

The two boxes 25 and 27 contain (for instance) disposable articles and the latter can be removed one by one through the openings 26 and 28 without in any way disturbing the boxes. An extremely simplified manipulation system is obtained for extracting disposable articles in a hospital.

What is claimed is:

1. A detachable holder, comprising:

a frame having a pair of outer longitudinally extending wire portions;

a pair of inner longitudinal wire portions extending substantially the length of said frame and substantially parallel to said pair of outer longitudinally extending wire portions;

a plurality of support units securably attached to said frame; and, a plurality of movable wire loops each having a first end and a second end, wherein said first end is movably secured between said pair of outer longitudinally extending wire portions and said pair of inner longitudinal wire portions.

2. The detachable holder of claim 1, wherein said frame further comprises first and second ends, wherein said first and second ends are bent inwardly.

3. A detachable holder of claim 1, wherein each of said plurality of support units includes a U-shaped portion.

4. The detachable holder of claim 1, wherein said pair of inner longitudinal wire portions are wavy configured.

5. The detachable holder of claim 1, wherein said plurality of support units are welded to said pair of outer longitudinally extending wire portions.

* * * * *